US006804837B1

(12) United States Patent
Guess, Sr.

(10) Patent No.: US 6,804,837 B1
(45) Date of Patent: Oct. 19, 2004

(54) ODOR TRANSPORTER SYSTEM FOR A TOILET BOWL

(76) Inventor: Robert L. Guess, Sr., 1022 Hiawassee Cir., Lincolnton, GA (US) 30817

( * ) Notice: Subject to any disclaimer, the term of this patent is extended or adjusted under 35 U.S.C. 154(b) by 0 days.

(21) Appl. No.: 10/657,599

(22) Filed: Sep. 9, 2003

(51) Int. Cl.[7] ..... E03D 9/04
(52) U.S. Cl. ..... 4/213
(58) Field of Search ..... 4/213

(56) References Cited

U.S. PATENT DOCUMENTS

| | | | | |
|---|---|---|---|---|
| 1,342,716 | A | 6/1920 | Johnston | |
| 2,105,794 | A | 1/1938 | Norris | |
| 2,279,789 | A | 4/1942 | Jentzer | |
| 2,985,890 | A | 5/1961 | Baither | |
| 3,192,539 | A | 7/1965 | Martz | |
| 3,295,147 | A | 1/1967 | Meyer | |
| 3,366,979 | A | 2/1968 | Johnston | |
| 3,495,282 | A | 2/1970 | Taggart | |
| 3,763,505 | A | 10/1973 | Zimmerman | |
| 3,887,948 | A | 6/1975 | Stamper | |
| 3,887,949 | A | 6/1975 | Osmond | |
| 3,900,908 | A | 8/1975 | Stump | |
| 3,939,506 | A | 2/1976 | Pearson | |
| 4,017,916 | A | 4/1977 | Pearson | |
| 4,031,574 | A | 6/1977 | Werner | |
| 4,153,956 | A | 5/1979 | Fischer, Sr. et al. | |
| 4,165,544 | A | 8/1979 | Barry | |
| 4,166,298 | A | 9/1979 | Pearson | |
| 4,318,192 | A | 3/1982 | Williams et al. | |
| 4,583,250 | A | 4/1986 | Valarao | |
| 4,590,629 | A | 5/1986 | Lusk | |
| 4,993,083 | A | 2/1991 | Lemieux | |
| 5,125,119 | A | 6/1992 | Munoz | |
| 5,161,262 | A | 11/1992 | Quaintance, Sr. | |
| 5,231,705 | A | 8/1993 | Ragusa | |
| 5,305,472 | A | 4/1994 | Eger | |
| 5,325,544 | A | 7/1994 | Busch | |
| 5,369,810 | A | 12/1994 | Warren | |
| 5,369,813 | A | 12/1994 | Goddard et al. | |
| 5,394,569 | A | 3/1995 | Poirier et al. | |
| 5,454,122 | A | 10/1995 | Bergeron | |
| 5,590,423 | A | 1/1997 | Boykin | |
| 5,718,005 | A | 2/1998 | Ng | |
| 5,819,324 | A | 10/1998 | Bianco | |
| 5,940,893 | A | 8/1999 | Shum | |
| 6,052,837 | A | 4/2000 | Norton et al. | |
| 6,351,855 | B1 | 3/2002 | Allen | |
| 6,370,703 | B1 | 4/2002 | Kim et al. | |
| 6,467,101 | B1 * | 10/2002 | Artola | 4/354 |
| 6,694,534 | B2 * | 2/2004 | Stone | 4/213 |

FOREIGN PATENT DOCUMENTS

| | | | |
|---|---|---|---|
| EP | 0 289 696 | A1 | 11/1988 |
| EP | 5-270404 | A | 8/1993 |
| EP | 8-89445 | A | 4/1996 |
| EP | 2000-139770 | A | 5/2000 |
| JP | 2001-225747 | A | 8/2001 |
| JP | 2001-336199 | A | 12/2001 |

* cited by examiner

*Primary Examiner*—Charles E. Phillips
(74) *Attorney, Agent, or Firm*—Richard C. Litman

(57) ABSTRACT

The odor transporter system for a toilet bowl comprises a box container hung on the rear wall of and inside the flush tank having an air/water valve hole in its front wall, and containing a tee connector. One horizontal tube exits from the tee connector to accept water from the conventional water feed valve. The second horizontal tube feeds into a reservoir mounted on a valve which is open on top and attached to an arm of a ball float. The third vertical tube passes down into the water overflow pipe inside the box container. A nylon cord attached to the side of the valve body passes through a ring located at the bottom of the box container to the flushing lever. The high vacuum for exhausting the foul air is created by a powerful air handler apparatus connected externally outside the toilet room, and controlled by the conventional wall mounted Light/fan switch or a remote RF switch.

8 Claims, 6 Drawing Sheets

ODOR TRANSPORTER SYSTEM FOR A TOILET BOWL

BACKGROUND OF THE INVENTION

1. Field of the Invention

The present invention relates generally to toilet plumbing. More specifically, the invention is a toilet bowl deodorizing mechanism that uses an external electric vacuum pump to draw air from the bowl into a ventilated area and out into the atmosphere by substantially sealing the gap between the lowered seat and the toilet bowl with a vinyl gasket.

2. Description of the Related Art

The related art of interest describes various toilet bowl odor eliminators, but none discloses the present invention that is simple, economical and effective in quickly removing the odor issuing from the toilet bowl while in use for fecal odor elimination. The relevant crowded art will be discussed in the order of perceived relevance to the present invention.

U.S. Pat. No. 3,763,505 issued on Oct. 9, 1973, to Joseph P. Zimmerman describes two embodiments of a toilet ventilation device comprising, in a first embodiment, a ventilator casing having a bottom hole resting on top of the flush tank and containing charcoal filters, a battery driven fan and a timer switch to exhaust the odor via the water feeding holes in the toilet bowl rim. In another embodiment, the ventilator casing rests on the floor, and a perforated ring or partial ring manifold under the toilet seat exhausts the noxious gas. The devices are distinguishable for requiring the ventilator casing adjacent the toilet bowl.

U.S. Pat. No. 6,052,837 issued on Apr. 25, 2000, to John A. Norton et al. describes a toilet ventilation system that moves air from within a toilet bowl and through a filter, or alternately, out of the building by an exhaust pipe. A seat assembly has an air channel defined by the lower surface of the seat. An air channel cover is removably held in place on the lower surface of the toilet covering the air channel. A bow-mounted base and enclosure is attached to the toilet bowl by standard mounting bolts. The seat and lid are pivotally carried by the bowl-mounted base. A reservoir with a drain opening prevents the passage of liquid into a fan and filter housing that is carried by the base and contains a fan powered by a direct current electrical system and an activated charcoal filter. The system is distinguishable for requiring the air filter and fan adjacent to the toilet bowl.

U.S. Pat. No. 5,819,324 issued on Oct. 13, 1998, to Ronnie D. Bianco describes a toilet ventilating device comprising a base mounted on the rim portion of a toilet bowl, and having a C-shaped vacuum member having a plurality of apertures superimposed on the inner periphery of the base. The vacuum member has a hollow handle and is connected to an exhaust hose and exhaust fan outside the room. The device is distinguishable for requiring a C-shaped exhaust member coupled to an external handle and a flexible hose.

U.S. Pat. No. 5,161,262 issued on Nov. 10, 1992, to Edwin G. Quaintance, Sr. describes an adjustable housing with two sections having neck portions for telescoping one section into the other section. Each section defines a wide, thin air inlet disposed adjacent the toilet bowl rim. In one section a battery pack, a timer circuit and on-off switches are included. The other section includes an activated charcoal filter and fan to draw foul air from both air inlets and returning the air to the ambient. The telescoping neck portions include a pair of sliding electric contacts to provide electricity to the fan motor. The apparatus is distinguishable for requiring a limited adjustable housing and exhausting the deodorized air into the ambient by the toilet bowl.

U.S. Pat. No. 1,342,716 issued on Jun. 8, 1920, to Edwin A. Johnston describes a toilet closet ventilator system comprising an exhaust motor and fan mounted in a pipe passing through the closet top and extending into the water and covering the overflow pipe. A switch box located below the closet or flush tank is actuated by a plunger connection to an arm from the pivot pin of the seat. The closet ventilator system is distinguishable for requiring a motor and exhaust fan adjacent the closet and its exhaust pipe inside the closet.

U.S. Pat. No. 2,105,794 issued on Jan. 18, 1938, to Charles C. Norris describes a combination closet tank cover and ventilator system comprising a blower unit integrated on top of the closet tank and having a circular fan to exhaust through a wall. The system is distinguishable for requiring the fan on top of the closet tank.

U.S. Pat. No. 2,279,789 issued on Apr. 14, 1942, to Henry Jentzer describes a toilet bowl ventilator system comprising an oval motor and fan in the vertical atmosphere vent pipe attached to the double elbow section fitting inside a semi-spherical cup of a water discharge (flush) pipe. The toilet seat has a switch underneath connected to house current, and activated by the weight of the user. The system is distinguishable for requiring a seat switch and a motor in the vertical air exhaust pipe.

U.S. Pat. No. 2,985,890 issued on May 30, 1961, to Harry Baither describes a toilet bowl ventilating apparatus comprising a water trap inside the flush tank, and a suction fan and motor housed in a casing secured to the rear wall of the flush tank. The apparatus is distinguishable for requiring the fan inside the flush tank.

U.S. Pat. No. 3,192,539 issued on Jul. 6, 1965, to William L. Martz describes ventilators for water closets, kitchens and the like. The ventilating -pipe extends from the overflow pipe inside the water closet to a vertical pipe having an exhaust fan in the attic to exit at the roof. The system is distinguishable for requiring a direct conduit from the overflow pipe to the roof.

U.S. Pat. No. 3,295,147 issued on Jan. 3, 1967, to Gustave Meyer describes a toilet stool ventilating device comprising a pneumatic pressure switch under a toilet seat with its hose connected to a large diameter hose connecting a flattened intake nozzle overlapping the rim of the toilet bowl to a wall connection containing an exhaust fan. The device is distinguishable for requiring a pneumatic pressure switch under the toilet seat and an overlapping toilet bowl rim exhaust hose.

U.S. Pat. No. 3,366,979 issued on Feb. 6, 1968, to Melvin I. Johnston describes a portable deodorizing apparatus for use on commodes comprising an actuating bulb under the seat connected by conduit to a box on the floor containing an exhaust fan, electric motor and two filtering sheets of charcoal. A plastic nozzle overlapping and fastened to the bowl rim is also connected to the box to exhaust the odoriferous gas to the box. The apparatus is distinguishable for containing the gas with in U.S. Pat. No. 3,495,282 issued on Feb. 17, 1970, to Allaird B. Taggart describes a toilet bowl and exhaust device comprising a blower-equipped ventilating conduit-connected at its discharge end to a venting stack and at its intake end to an exhaust pipe within the confines of the tank rising to an inlet point over the normal water level in the tank. The lid of the tank has a sealing gasket that makes the upper part of the tank airtight. The device is distinguishable for requiring the venting from inside the flush tank and sealing the flush tank.

U.S. Pat. No. 3,887,948 issued on Jun. 10, 1975, to Robin H. Stamper describes a conditioning pack device in FIG. 5 for deodorizing and/or odorizing air comprising a deodorizer pack containing a battery driving a fan, wherein the pack is attached to a pipe and duct attached under the toilet seat. The on/off switch is included inside the duct with the electrical wire leading to the external pack. A molded seal has two ends leading to the duct with gas inlets. The system requires a molded seal under the toilet seat with presumably a pressure switch to turn on the small fan inside the pack device containing also an activated carbon filter. The system is distinguishable for requiring a fan in the separate deodorizing pack.

U.S. Pat. No. 3,887,949 issued on Jun. 10, 1975, to John S. Osmond describes a ventilated seating for a water closet comprising an adapter in the form of a blower housing affixed to the toilet bowl as the static hinge structure for the movable seat and cover. A low power electrical system has a control switch housed for response to the body weight of a person for automatic blower operation to exhaust the odor to a pipe. The system is distinguishable for being limited to the blower housing positioned in the rear of the toilet seat.

U.S. Pat. No. 3,900,908 issued on Aug. 26, 1975, to Galen L. Stump describes a water closet evacuation system comprising a conduit mounted inside the flush tank over the overflow conduit, extending through a building wall to a squirrel fan and discharging the air to the attic. The control is a mercury level switch mounted on the toilet seat lid, so that when the lid is raised, the fan operates. The system is distinguishable for requiring a mercury level switch and an exhaust fan inside the building wall.

U.S. Pat. Nos. 3,939,506 issued on Feb. 24, 1976, and 4,017,916 issued on Apr. 19, 1977, to Raymond H. Pearson describe an odor control ventilator system including a motion-responsive electrical transducer comprising an exhaust connected to the upper portion of a toilet water tank for withdrawing odors from the toilet bowl through the overflow pipe in the water tank and flush water distribution outlets in the toilet bowl, a fawn located in the attic to establish the odorous air flow, a control for initiating and terminating the odorous air flow, and an electric transducer responsive to the motion of the toilet flushing mechanism so as to terminate the air flow at the moment the toilet is flushed. The system is distinguishable for requiring an electric transducer for initiating and terminating the air flow.

U.S. Pat. No. 4,031,574 issued on Jun. 28, 1977, to Frank D. Werner describes a timed ventilator for a toilet mounted entirely within the toilet tank, and operated by battery to remove air from the toilet bowl through a charcoal filter. An external control includes an automatic time delay that will hold the fan on for a desired length of time necessary to change the air in the small volume of the toilet bowl. The device is distinguishable for requiring the entire system to be confined to the flush tank.

U.S. Pat. No. 4,153,956 issued on May 15, 1979, to Raymond C. Fischer, Sr. et al. describes a toilet deodorizer device comprising the arrangement in the upper portion of a toilet tank for drawing air from the rim portion of a toilet bowl upwardly through a conventional overflow pipe provided in the tank for exhaust at the top of the tank. The assembly is supported by a diaphragm constructed from a gas permeable material. A fan and heater unit including a blower draws the air through the toilet tank. A heater at the outlet of the blower deodorizes the air by the application of extreme heat. The device is distinguishable for requiring extreme heat from a heater.

U.S. Pat. No. 4,165,544 issued on Aug. 28, 1979, to Bill H. Barry describes an odorless toilet stool comprising a system including a vertical open top overflow passageway connected to the discharge pipe so that water in excess of the desired level in the flush tank is dispensed in the toilet bowl, and through which odorous air may be-withdrawn from the toilet bowl. A hollow open bottom member is positioned over the upper end of the overflow pipe to provide a water seal and a close communication between the overflow passage and the sleeve. An air pump is connected to the sleeve to move air from the stool through the overflow pipe and sleeve for a remote exhaust. The system is distinguishable for requiring a connection over the overflow pipe.

U.S. Pat. No. 4,166,298 issued on Sep. 4, 1979, to Raymond H. Pearson describes a toilet deodorizer device having a housing containing a motor-driven fan and an activated charcoal filter mounted within the flush tank air chamber. The housing divides the air chamber into an intake receptacle inside the housing and an electrically driven fan wheel outside the housing. The intake receptacle is open to the overflow conduit through an inlet aperture, and is open to the exhaust receptacle through an outlet aperture. The fan exhausts air, from the closet bowl through the overflow conduit and through the filter into the exhaust chamber to deodorize the closet bowl. The electrical controls were considered conventional. The device is distinguishable for requiring the filter to be within the flush tank.

U.S. Pat. No. 4,318,192 issued on Mar. 9, 1982, to Jack D. Williams et al. describes a ventilated toilet comprising a flapper valve assembly having coaxial air intake and air discharge tubes. The outer air intake tube is connected at its lower end to the flush discharge outlet of the holding tank. The inner tube protrudes downwardly through the flush discharge outlet and through the porcelain wall separating the siphon portion of the toilet waste discharge duct from the flush conduit connecting the flush discharge outlet of the holding tank to the annular water discharge channel in the rim of the toilet bowl. An electric fan withdraws contaminated air from the toilet bowl through the annular channel between the inner and outer flapper valve tubes and vents downwardly through the inner tube to the siphon portion of the waste duct to be discharged. A conventional flapper valve is offset from and connected to the outer one of the pair of coaxial tubes. The assembly is distinguishable for being restricted inside the water tank and to a flapper valve assembly.

U.S. Pat. No. 4,583,250 issued on Apr. 22, 1986, to Bonifacio C. Valarao describes a device for the removal of foul air from toilet bowls comprising a separate housing over the flush tank containing an electric motor driving an exhaust fan and connected to house current. The base of the housing contains two charcoal filters. The conventional overflow tube is connected by a sleeve portion having a dip pipe and a suction tube that is connected to the fan and a water refill tube. The device is distinguishable for requiring its operating parts inside the water tank.

U.S. Pat. No. 4,590,629 issued on May 27, 1986, to Leonard A. Lusk describes a toilet ventilating device comprising an air pump connected to an odor outlet fitting containing a gas diffuser communicating with the toilet bowl. Air is withdrawn from the toilet bowl and discharged into the water reservoir through the outlet fitting so that the water will filter the odorous gases. The device is distinguishable for being entirely inside the water tank to filter with tank water.

U.S. Pat. No. 4,993,083 issued on Feb. 19, 1991, to Charles E. Lemieux describes a self-ventilating toilet comprising an air intake chamber integrated with the toilet bowl superposed above a water discharge chamber. A tubular member leading to the water discharge is vertically disposed and extends through the air intake chamber having a squirrel fan, and is provided with apertures to allow the water flowing in the tubular member to flow through the air intake chamber to clean the chamber. The toilet is distinguishable for requiring the self-ventilating components to be integrated within the toilet bowl.

U.S. Pat. No. 5,125,119 issued on Jun. 30, 1992, to Jesus Munoz describes an odor reduction toilet apparatus comprising the incremental discharge, release and circulation of small quantities of deodorant within the air and water from the toilet bowl during a flush. The apparatus is distinguishable for requiring deodorant distribution during a flush.

U.S. Pat. No. 5,231,705 issued on Aug. 3, 1993, to Peter Ragusa describes a method and apparatus for eliminating toilet odors comprising an air intake port located in the toilet bowl. A battery powered suction pump assembly contained in the tank is connected to the air intake port by suction tubing. A charcoal filter is connected to the suction pump assembly that passes the odoriferous air through the filter prior to exhausting the filtered air into an exhaust tube and to the overflow tube. The apparatus is distinguishable for requiring all of its components inside the flush tank.

U.S. Pat. No. 5,305,472 issued on Apr. 26, 1994, to Leroy O. Eger describes a ventilation unit for a toilet comprising a vacuum motor mounted in wall voids surrounding the toilet that is connected to the back of the tank and utilizes the water passageway of a conventional toilet to draw odor aromas from the toilet. A vacuum shut off-valve is mounted adjacent the rear of the tank, and is actuated concomitantly with the rising and lowering of the water level to cut off the airflow from the toilet. An additional valve is mounted adjacent the tank to act in opposition to the shut-off valve and provide relief from the vacuum created from the drop of the water level during flushing.

A release valve is adjacent the vacuum motor in the attic to draw air from an air source alternative to the toilet, when the shut-off valve is actuated. Another embodiment includes means for automatically activating and de-activating the vacuum motor in accordance with the movement of the toilet lid by incorporating a reflector in the lid and a photo-relay infrared sensor mounted in the ceiling to detect light from the reflector. The sensor is electrically connected to the attic motor to activate the motor when the toilet lid is lifted for use and deactivated when the lid is lowered. The system is distinguishable for requiring a vacuum shut-off valve behind the valve and an infrared sensor system.

U.S. Pat. No. 5,325,544 issued on Jul. 5, 1994, to Michael S. Busch describes a toilet flush tank and bowl air deodorizing apparatus comprising a fan, an annular air filter, and housing mounted within the flush tank on the overflow tube that is modified to have a smaller filler tube for overflow. The batteries are enclosed in a box hung on the inside of the rear wall of the tank, and energized by an on/off switch and timer on the outside of the rear wall. The apparatus is distinguishable for requiring all the functioning parts inside the flush tank.

U.S. Pat. No. 5,369,810 issued on Dec. 6, 1994, to H. Ray Warren describes a malodorous air entrapment apparatus disposed inside the flushing tank of a toilet for drawing and entrapping malodorous air from the toilet bowl. A cartridge box positioned at the rear and to one side adjacent the lid in the tank contains a blower, multiple D.C. batteries in series and a charcoal filter activated by an external infrared sensor adjacent to the lid. An optional air seal is provided under the seat. The apparatus is distinguishable for requiring the cartridge box with its blower inside the flush tank.

U.S. Pat. No. 5,369,813 issued on Dec. 6, 1994, to Lewis W. Goddard et al. describes a self-contained toilet venting system comprising a rectangular flat box functionally integrated with the tank lid to accept noxious air from the toilet bowl through the overfill pipe when the timer switch on top of the tank lid is activated to run the fan in the box. The noxious air is drawn into the box by a fan energized by neighboring dry cell batteries, and passes through a bed of activated charcoal and out under the tank lid. The system is distinguishable for requiring the venting apparatus within the water tank.

U.S. Pat. No. 5,394,569 issued on Mar. 7, 1995, to Paul Poirier et al. describes an air venting apparatus mounted inside the water tank for evacuating noxious air to the outside of the room comprising a main closed air chamber adjacent the lid and containing a fan above the water level. A siphon assembly is provided for fluidly interconnecting in airtight fashion the discharge pipe to an upstream section of the air chamber. A nozzle assembly is provided for fluidly interconnecting a downstream end of the air chamber to the outside of the room. The apparatus is distinguishable for requiring the fan inside the water tank.

U.S. Pat. No. 5,454,122 issued on Oct. 3, 1995, to Donald J. Bergeron describes a toilet ventilator with room air freshener and comfort heater comprising the ventilation of the noxious gas within the toilet bowl, deodorizing the gas and returning the deodorized gas to the toilet bowl. The system is distinguishable for requiring air freshener and heating elements.

U.S. Pat. No. 5,590,423 issued on Jan. 7, 1997, to Dwight L. Boykin describes a commode odor extractor device comprising a U-shaped suction fitting having an interior lip that extends into the commode bowl and suction apertures on its bottom surface. A dual port vent hose fitting has two connecting ports adapted for connection with a venting hose. A momentary contact switch extends from the fitting. The device is distinguishable for being limited to a suction fitting positioned at the rear of the toilet seat.

U.S. Pat. No. 5,606,747 issued on Mar. 4, 1997, to Andre Dupont describes a toilet bowl aspirating system comprising a right-angled tubular top element connected above the overflow tube connected to a filter pouch made of a flexible material impregnated with carbon and containing a fan and motor energized by a battery in a container hung from the rear wall of the flush tank. The aspirating system is controlled by a switch located on the front wall of the flush tank, and activated when the lid is raised against it. A timer for operation is set for a four minute period. The system is distinguishable for requiring the fan and motor inside the flush tank.

U.S. Pat. No. 5,718,005 issued on Feb. 17, 1998, to KamSik Ng describes three embodiments of a foul air remover device for a toilet comprising, in a first preferred embodiment, a foul air remover box containing a frontal air intake chamber, an intermediate partitioning chamber containing a small fan, and a deodorizing chamber having top and bottom baffling and a deodorizing liquid. Holes in the bottom portion of the last chamber allow the tank water to enter. The air intake chamber is connected to an elbow fitting on the overflow pipe, and includes a tube feeding refill water from the water intake pipe. Th e elbow fitting at the juncture with the overflow pipe has space determined by plastic locking bolts. The fan is energized by an electrical power source of 12 volts D.C. and 0.5 ampere. The fan wiring is not disclosed. The system is distinguishable for requiring the three-chambered air intake chamber having a small fan.

U.S. Pat. No. 5,940,893 issued on Aug. 24, 1999, to Hai Shum describes a feasible odorless water closet apparatus comprising a device threadingly attached to the top of the refill tube consisting of three stacked cylinders with the topmost cylinder having an air duct directed downward into the tank water. The larger diameter bottom cylinder has a collar with four brace members threaded to a second cylinder considered an air chamber connected to a water refilling tube. The topmost domed cylinder has an air blower forcing air through an elbow connected to a downwardly directed air duct having Six diffuser elements immersed in water. The elbow has an electric magnet connected by wire to a terminal on the domed cylinder. An automatic switch on the bottom of the toilet seat upon pressure signals by wire to the air blower to begin. The wiring also connects a D.C. battery box on top of the tank cover to a manual switch located in a "convenient location". Thus, the foul air is dispersed into the tank water. The apparatus is distinguishable for requiring the air blower inside the water tank.

U.S. Pat. No. US 6,351,855 B1 issued on Mar. 5, 2002, to Larry F. Allen describes, as best understood, a bathroom odor withdrawal system comprising a device mounted on the overflow tube in the commode water tank, and has three chambers. The first chamber receives the overflow tube. The second chamber contains a fan, a motor and a battery pack. The third chamber contains activated charcoal, and the deodorized air is passed into the space above the water level. The energizing wire from the fan passes to one side of the water tank and is clipped to the sidewall to end at a "bow switch". The system is distinguishable for requiring the air blower inside the water tank.

U.S. Pat. No. US 6,370,703 B1 issued on Apr. 16, 2002, to Kyung T. Kim et al. describes an odorless toilet including a fan to draw the malodorous odor from the toilet bowl to the sewer line. The tank is controlled to have a low water volume when not used and a high water volume when one sits on the seat. The tank assembly includes a pivoting trap cover having an open bottom, an interior separator wall to establish a water trap or seal between an interior chamber and an exhaust conduit from the tank to the sewer line. In a raised position of the trap cover, the separator permits airflow from the interior chamber into the exhaust conduit and down to the sewer. When a person sits on the seat, the fan is activated to increase air pressure in the trap cover to decrease air pressure inside a float of the float valve via a venturi tube. The adjusted pressure causes the float valve to open to permit a high water volume in the tank and causes the float valve to open to permit a high water volume in the tank. The increased air pressure in the trap cover causes the trap cover to rise to draw toilet bowl gases into the exhaust conduit. The apparatus is distinguishable for requiring a fan contained in the trap cover.

European Patent Application Publication No. 0 289 696 A1 published on Nov. 9, 1988, to Nevio Savorani, describes an aspirator-deodorizer device for water closets comprising an electric fan in a housing attached either to the outside wall of the toilet bowl by a goose beak intake duct on the bowl rim or to the bathroom wall. Both units contain a fan and are energized by house current and backed up by an internal rechargeable battery. The housing also contains an activated carbon filter within a drawer. The device is activated by photocells that sense when the user sits on the toilet seat. The device is distinguishable for requiring its position on the toilet bowl rim or on a wall, and activation thereof by photo sensors.

European Patent Application Publication No. 0 555 984 A1 published on Aug. 18, 1993, for Gerard Serre comprises a method of operating a vacuum toilet system on a transport vehicle which includes malodorous air combating means such as a filter to reduce the objectionable effect of malodorous air periodically exhausted from the system, and characterized by its use only at vehicle speeds below a preset limit value. The system is distinguishable for being limited to an air filter mounted in a vehicle.

Japan Patent Publication No. JP 8-89445 A published on Apr. 9, 1996, for Takahiro Oshima describes a hollow chambered toilet seat with four deodorizing and partitioned bottom openings for sucking in air when activated by a wall switch for a vacuum machine energized by at least 40 Watts also mounted on a wall. The system is distinguishable for requiring the toilet seat to suck in the odoriferous gas and failing to require a deodorizing filter.

Japan Patent Publication No. JP 2000-139770 A published on Apr. 9, 1996, for Susumu Nakatani et al., as best understood, describes a port for sucking odor provided at an upper part of a feces receiving part of the toilet bowl. An odor suction on/off valve is opened, a communications port on the side of a vacuum device is closed, and the odor is sucked by the odor suction port that is above the feces receiving part. The system is distinguishable for requiring a suction port in the toilet bowl, a vacuum means and a pipe network.

Japan Patent Publication No. JP 2001-225747 A published on Aug. 21, 2001, for Yoshiaki Ooka describes a vacuum toilet deodorizing system for a septic tank, as best understood, that positively prevents the foul odor release from a septic tank without the use of an odor removing device. A solenoid valve is opened during the release of foul gas from the septic tank to cause the exhaust pipe to open when the septic tank pressure exceeds a certain pressure. The system is distinguishable for being limited to a septic tank.

Japan Patent Publication No. JP 2001-336199 A published on Dec. 7, 2001, for Yoshifumi Moriya et al. describes a toilet deodorizing system comprising, as best understood, a deodorizing unit located behind the toilet bowl containing an air exhaust pipe and a deodorizing fan at its bottom to receive foul air through a deodorizing section, and a control circuit on top that receives signals from an odor detector and a human body detector. A long nozzle extends horizontally from the deodorizing unit to the toilet bowl under the toilet seat to receive the emanating foul air. The system is distinguishable for requiring, the deodorizing unit directly behind the toilet bowl and a control circuit for the odor and human body detectors.

None of the above inventions and patents, taken either singly or in combination, is seen to describe the instant invention as claimed. Thus, an odor transporter system for a toilet bowl solving the aforementioned problems is desired.

SUMMARY OF THE INVENTION

The invention is an odor transporter system for a toilet bowl, made up of a container hung on the rear wall of and inside the flush tank having an air/water valve hole in its front wall, and a tee connector above its top wall. One horizontal tube from the tee connector accepts water from a conventional water valve. A vertical tube passes into the overflow pipe inside the, box container. An elbow from the second horizontal tube feeds into a reservoir mounted on the rotatable air/water valve located on the front wall of the container that is open on top and attached to an arm of a ball float. A nylon cord attached to the side of the valve body passes through a ring located at the bottom of the container and to the flushing lever. The high vacuum for exhausting the foul air is created by a powerful squirrel cage type air handler device connected externally outside the toilet room to maintain quiet, and controlled by a variable silicon controlled rectifier (SCR) speed control device which is in a parallel circuit with the bathroom light/fan switch located adjacent the toilet to gain the proper vacuum level required.

Accordingly, it is a principal object of the invention to provide an odor transporter system for evacuating the foul odor in a toilet bowl.

It is another object of the invention to provide a box container hung inside the flush tank containing a rotatable air/water valve.

It is a further object of the invention to provide a rotatable air/water valve attached to an arm of a ball float.

Still another object of the invention is to provide a large capacity motor powering a squirrel cage air handler device positioned outside the toilet room to create a high vacuum force to evacuate the toilet bowl's foul odor.

It is an object of the invention to provide improved elements and arrangements thereof for the purposes described which is inexpensive, almost invisible, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
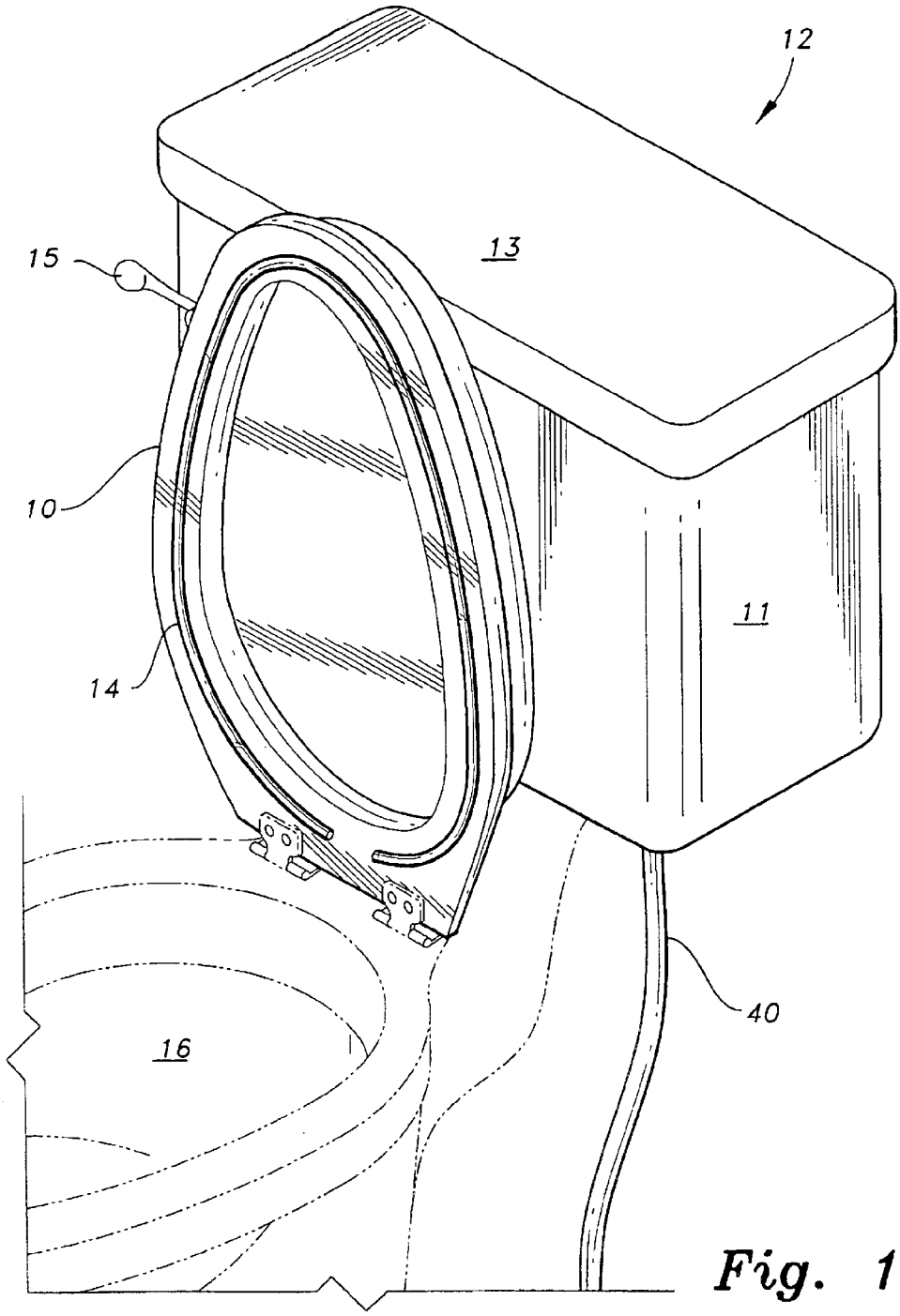
FIG. 1 is an environmental, perspective front view of an improved toilet seat with a vinyl tubing adhered on its bottom surface functioning as a seal and part of the fecal odor transporter system for eliminating the odoriferous odor during the use of the toilet according to the present invention.

The present invention is directed to an efficient odor transporter system based on novel apparatus for removing foul odors from a toilet bowl during defecation. In FIG. 1, the toilet seat 10 of a home toilet 12 is modified by gluing a clear vinyl tubing 14 having a ⅜-inch diameter to its bottom surface on a toilet bowl 16. The conventional ceramic flush tank 11 is covered by a ceramic lid 13 and flushed by a flush lever 15. An overflow water drainpipe 17 maintains the water level in the toilet bowl in FIGS. 2A and 3A. This modification ensures no air leaking in under the conventional toilet seat with plastic knobs removed. It is assumed that room air would still enter the toilet bowl 16 from the user's crotch area in response to the vacuum created to confine the foul air and aid in its removal into the transporter system.

Figure 2A:
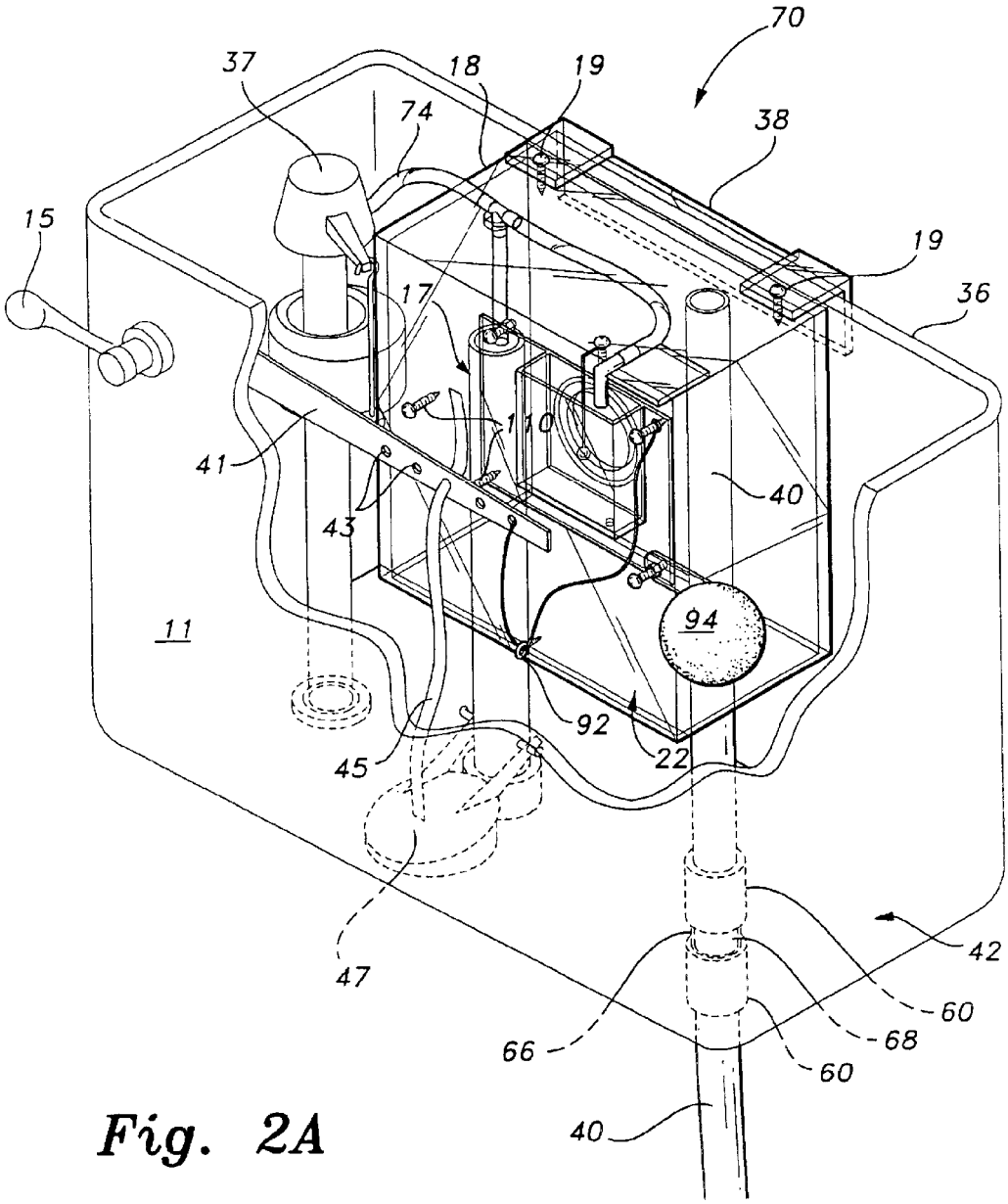
FIG. 2A is an environmental perspective front view of the system inside a flush tank.

FIG. 2A illustrates the placement of the container box 18 with an open bottom 22 preferably made from the following clear plastic plates: top plate 20, right sidewall 24, left sidewall 26, front sidewall 28, and rear sidewall 30. The front sidewall 28 has a hole 32 made adjacent the top sidewall 20 and the right sidewall 24. The container box 18 is hung over the rear wall 34 of the water tank 36 by a bracket 38 attached to the top edge of the water tank. It should be noted that the container box 18 need not be restricted to a box form, but can be a molded container having smooth corners with a flat vertical front.

The other conventional parts in the flush tank 11 are a water flush valve 37, a water fill drainage pipe 17, a flush lever arm 41, and apertures 43 in the lever arm 41 for tying the cord 45 attached to the flapper valve 47.

Figure 4:
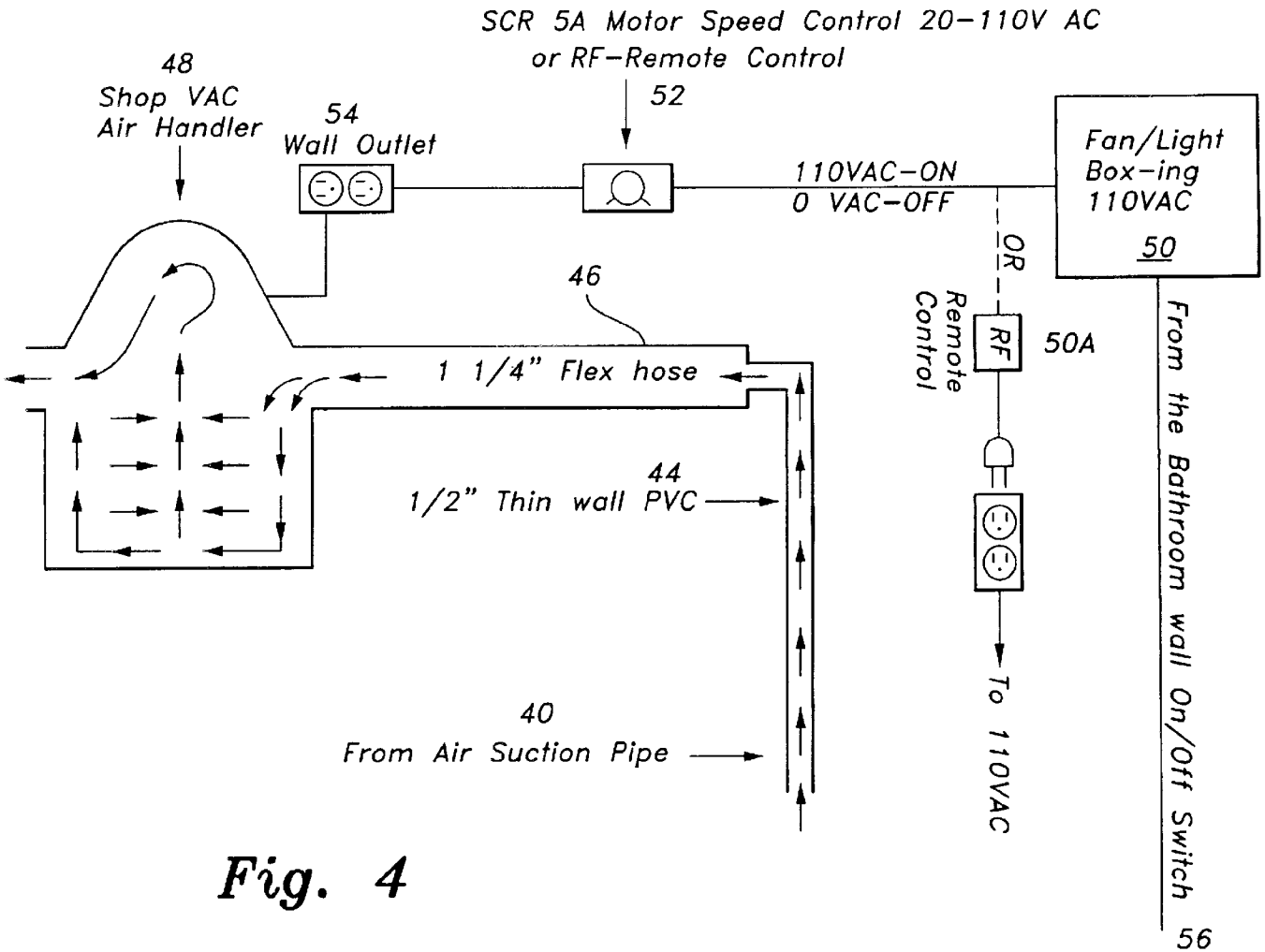
FIG. 4 is a plan view of a graphical vacuum circuit with its explanatory notations.

Included inside the container box 18 is a vertical polyvinyl chloride pipe described as an air suction pipe 40 that passes through the bottom wall 42 of the tank 36. In FIG. 4, a half-inch diameter, thin walled polyvinyl chloride tube 44 extends from the air suction pipe 40 to the 1.25-inch diameter flexible corrugated hose 46 of a one horsepower vacuum machine 48 such as a Shop VAC Air Handler(TM) that can be located in the attic or under the house to expel the exhausted air to the ambient. The on/off wall outlet 54 in the bathroom is wired to either a fan/light box-ing 50 operating at 110 volts A.C. or can be remotely controlled by a radio frequency control device, 50A energized by a wall outlet operating at 110 volts A.C. A silicon control rectifier (SCR) device 52 operating at 5 amperes and 20 to 110 volts A.C. controls the motor speed of the Air Handler machine 48, and is wired in series to a wall outlet 54. The fan/light Box-ing 50 is wired to the bathroom wall positioned on/off switch 56. Thus, a more effective increase in vacuum power will evacuate the odor quickly and quietly.

Figure 2B:
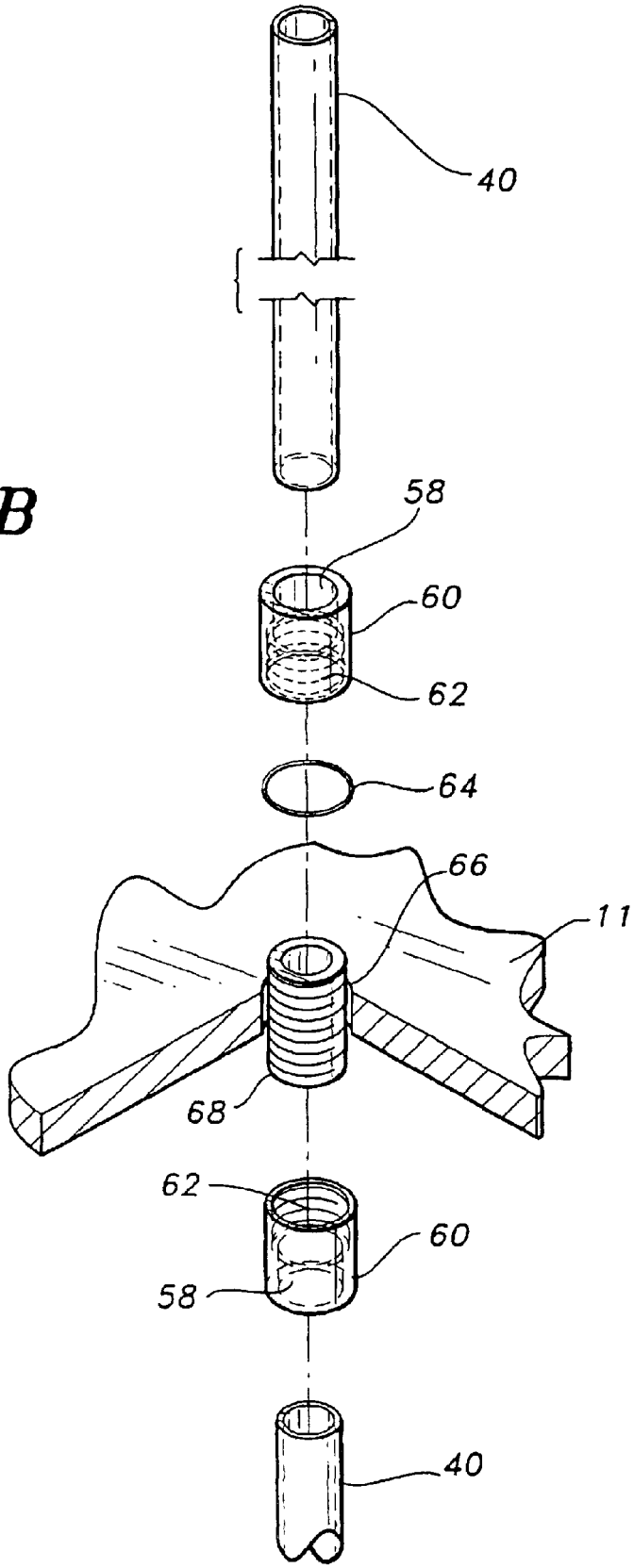
FIG. 2B is an exploded view of the air suction pipe shown in FIG. 2A.

In FIG. 2B, the various connecting parts of the system begins from the 11 inches long polyvinyl chloride tube or air suction pipe 40 having a half-inch diameter being attached to the slip end 58 of a half-inch female adapter 60 having an internally threaded opposite end 62. An O-ring 64 having an internal diameter of 13/16 inch and 3/32 inch thick is used to seal the ¾ inch diameter hole 66 in the ½ inch thick bottom wall of the flush tank 11. A schedule 80 nipple 68 having an outer diameter of ¾ inch and 1¼ inch in length fits inside the hole 66 of the flush tank 11. Another female adapter 60 is threaded onto the nipple 68. Finally, the half-inch diameter, thin wall polyvinyl chloride tubing or pipe 17 is attached to suck the air to the vacuum machine 48 depicted in FIG. 4. This plumbing arrangement ensures a leak proof connection between the flush tank 11 and the vacuum machine 48.

Figure 3A:
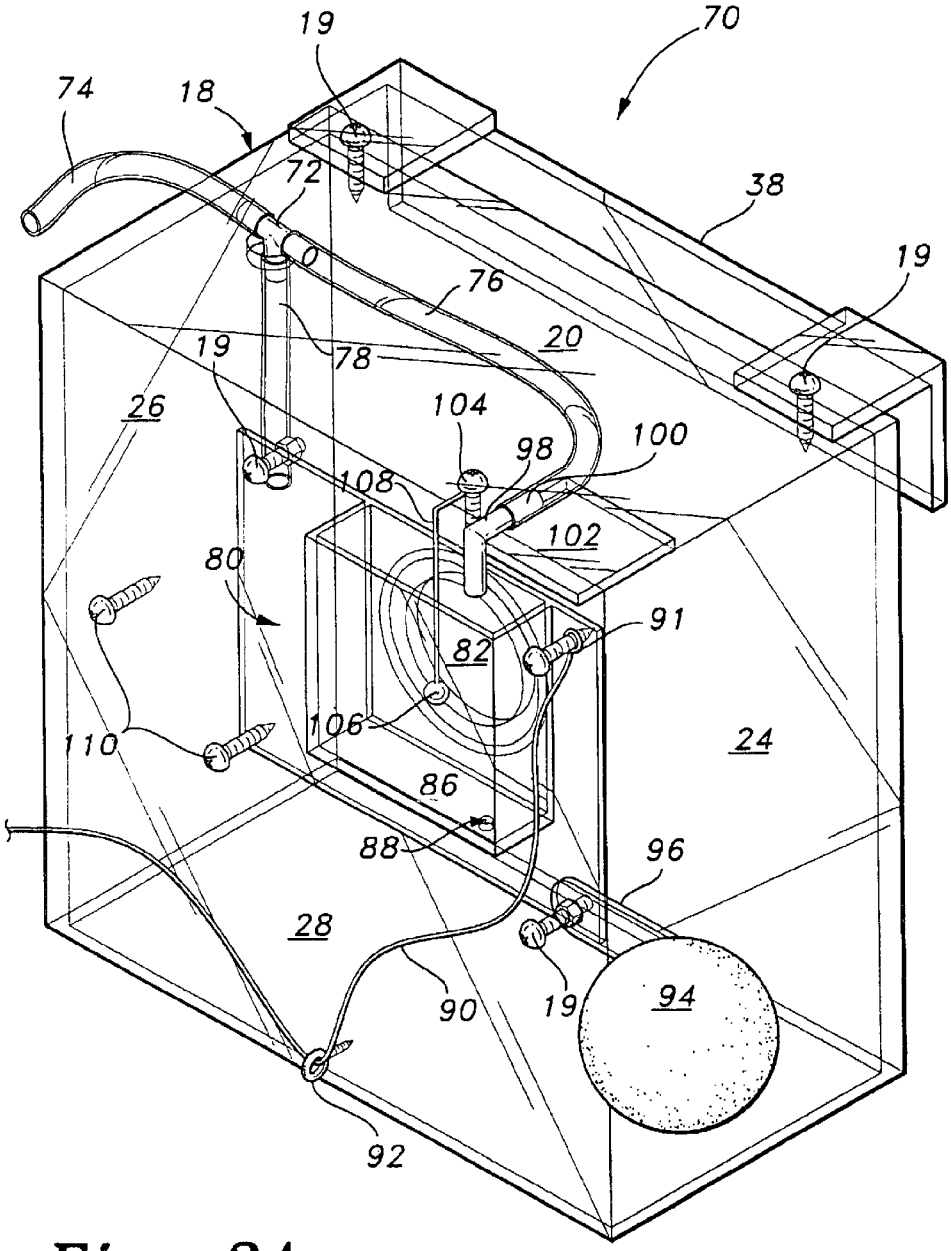
FIG. 3A is an environmental elevated view of the closed air/water valve device in the flush tank.
Figure 3B:
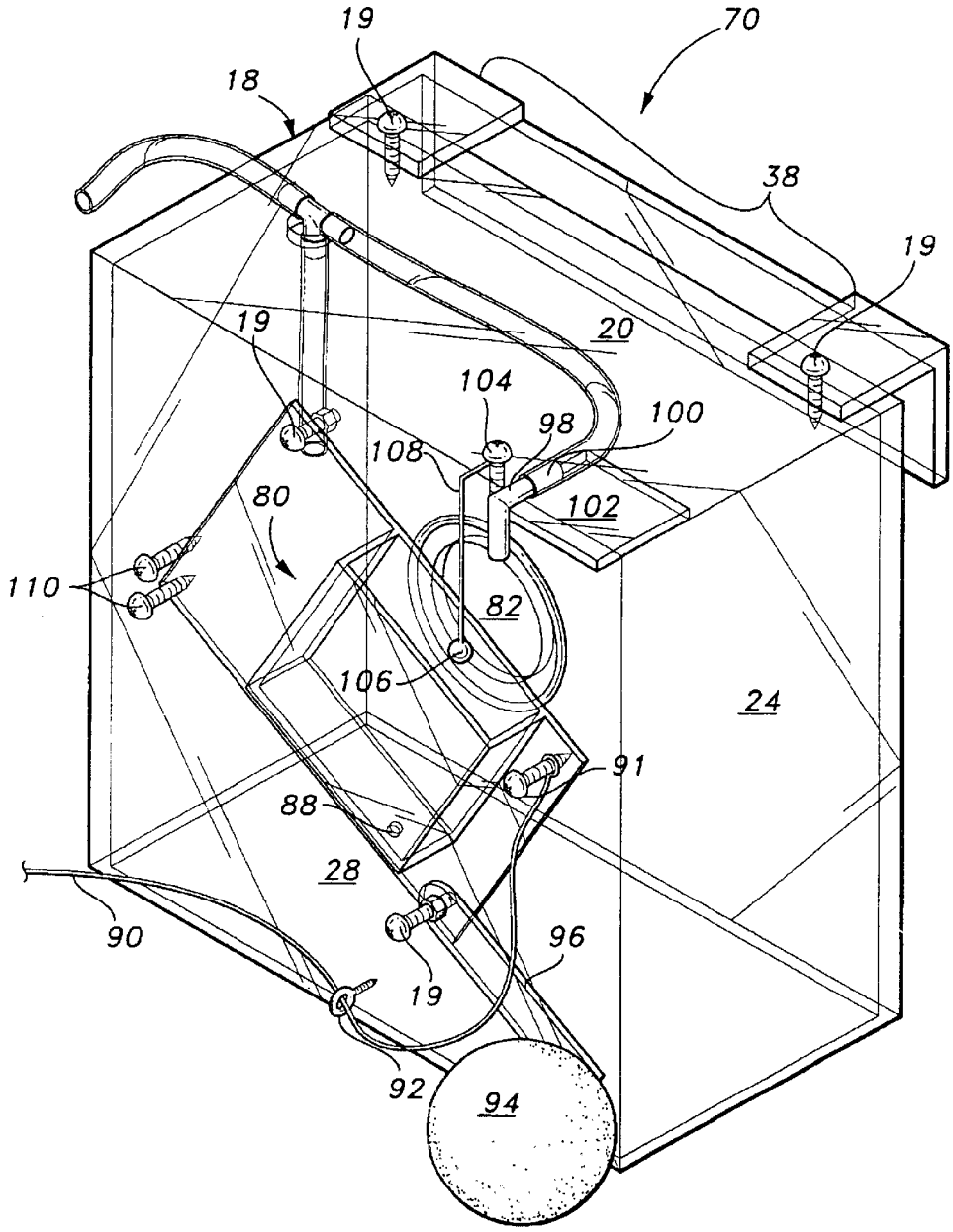
FIG. 3B is an environmental elevated view of the open air/water valve device in the flush tank.

FIG. 3A (closed valve condition) and FIG. 3B (open valve condition), taken with FIG. 2A, explain the operation of the air and water valve device 70. A metal tee fitting 72 has a first horizontal tube 74, a second horizontal tube 76 and a third vertical tube 78 connected to it. Tube 74 is connected to the conventional water valve 37 (FIG. 2A) and functions as a water feeding conduit. Tube 76 functions as a water feed to the gate reservoir 86 attached to the cover plate or gate 80. The vertical tube 78 feeds into the water overflow drainage pipe 17 (FIG. 2A)

A rotatable rectangular plastic plate 80 is hinged at one upper left corner by a fastener 19 to the front sidewall 28 of the box 18 proximate the upper right corner. The cover plate or gate 80 covers a circular hole 82 rimmed with a gasket ring 84 and having a diameter of 1¼ inches. The cover plate 80 also has a small square gate reservoir 86 open on top and a 1/16 inch diameter hole 88 in its bottom. A 20 lb. test nylon line 90 is tied between the flush lever 15 and the fastener 91 on the upper right corner of the air valve gate 80 via a bottom eyebolt 92. A ball float 94 attached to the end of a rod 96 is attached by fastener 19A to the lower right corner of the gate 80.

The vinyl horizontal tube 76 is connected to ¼ inch diameter elbow 98 and fastened by a bracket 100 to a flat square support plate 102 positioned in the right front corner of box 18. A fastener 104 adjacent the elbow 98 suspends a ball 106 on a right-angled rod 108 in front of the hole 82. This device is a support device to align gate 80 over the gasket ring 84.

When the toilet 12 is flushed, the nylon line 90 pulls the air valve gate 80 down, exposing the hole 88 to provide a better air path than the overflow drainage pipe 17, because it is now flooded with flush water. The water level in the flush tank 11 begins to drop, and the water fill valve 37 opens to supply water to refill the tank 11, and to refill the toilet bowl 16 through the overflow pipe 17. The weight and pressure of the of the water fed by the elbow 98 into the gate reservoir 86 holds the air valve gate 80 open until the water fill valve 37 is satisfied and cuts of f to stop the water f low in the gate reservoir 86. Since the gate reservoir 86 has a bottom hole 88, any water left drains out and allows the buoyancy of the ball float 94 to close the gate 80, so that the vacuum is again imposed on the overflow pipe 17 and air is removed from the bowl 16 of the toilet 12.

The invention can either be retrofitted to an installed toilet or manufactured with a toilet.

Thus, an efficient and effective apparatus for removing the foul air from a toilet being used has been disclosed.

It is to be understood that the present invention is not limited to the embodiment described above, but encompasses any and all embodiments within the scope of the following claims.

I claim:

1. An odor transporter system for a toilet bowl comprising:

a sitting toilet apparatus having a toilet bowl, a toilet seat, and a flush tank having a flush handle and containing a conventional compact water valve and a water overfill drain pipe;

an air suction pipe positioned adjacent the water overfill drain pipe and connected to an external vacuum line;

an air/water valve device positioned to hang inside the flush tank from a rear rim comprising;

a first container having planar walls comprising a front wall, sidewalls, and a top wall;

said top wall having a bracket attached for hanging;

said front wall having a hole of a substantial diameter in an upper right hand corner;

a rectangular plate of smaller dimensions than the first container, being rotatably hinged at its upper left corner to the front wall of the first container and its right edge coincident with the sidewall of the first container;

an adjustable float ball having a handle is attached to the lower right corner of the rectangular plate;

a second smaller container positioned over the hole having two sidewalls and a bottom wall having a small aperture;

a tee connector having a first horizontal tube connected to the water supply duct of the conventional water valve;

a second horizontal tube connected to the tee connector and an elbow at its opposite end being located over the second container;

a third vertical tube connected to the tee connector and extended into the conventional overflow pipe; and a remote suction source having an exhaustive power and capacity to exhaust any odoriferous air from the toilet bowl via the air suction pipe;

whereby the odoriferous air is quickly exhausted from the toilet bowl.

2. The odor transporter system according to claim 1, wherein an existing light/fan wall switch proximate the bathroom is provided in line with the remote suction source.

3. The odor transporter system according to claim 1, wherein an O-ring is positioned around the hole of the front sidewall of the first container.

4. The odor transporter system according to claim 1, wherein a nylon cord tied to the first container of the water and air valve device, and passing through an eyebolt positioned on the bottom of the flush tank to end at the flush lever.

5. The odor transporter system according to claim 1, wherein the remote suction source is located in either an attic, a basement or under a building.

6. The odor transporter system according to claim 5, wherein the remote suction source has a variable rotational speed.

7. The odor transporter system according to claim 1, wherein the air/water valve device consists essentially of polyvinyl chloride plates and tubes.

8. The odor transporter system according to claim 1, wherein the air/water valve device has a bracket for hanging on the top of the flush tank.

* * * * *